US008100301B2

(12) United States Patent
Babiarz

(10) Patent No.: US 8,100,301 B2
(45) Date of Patent: Jan. 24, 2012

(54) SANDBAG FILLING APPARATUS

(76) Inventor: Stacey A. Babiarz, Edgerton, WI (US)

( * ) Notice: Subject to any disclaimer, the term of this patent is extended or adjusted under 35 U.S.C. 154(b) by 441 days.

(21) Appl. No.: 12/436,499

(22) Filed: May 6, 2009

(65) Prior Publication Data

US 2010/0282780 A1 Nov. 11, 2010

(51) Int. Cl.

| | |
|---|---|
| ***B65B 1/12*** | (2006.01) |
| ***B65B 1/10*** | (2006.01) |
| ***B65B 1/04*** | (2006.01) |
| ***B65B 1/00*** | (2006.01) |
| ***B65D 88/66*** | (2006.01) |
| ***B65D 88/64*** | (2006.01) |

(52) U.S. Cl. ..... 222/196; 222/226; 222/333; 222/412; 141/231; 141/256; 141/313

(58) Field of Classification Search ..... 222/196, 222/198, 226, 333, 412; 141/10, 67, 72, 141/98, 114, 166, 231, 256, 313, 392; 414/495, 414/507, 526; 198/300

See application file for complete search history.

(56) References Cited

U.S. PATENT DOCUMENTS

| | | | | |
|---|---|---|---|---|
| 4,184,522 | A | 1/1980 | Waite | |
| 4,763,702 | A * | 8/1988 | High et al. | 141/114 |
| 5,121,775 | A * | 6/1992 | McClain | 141/83 |
| 5,215,127 | A * | 6/1993 | Bergeron | 141/10 |
| 5,353,851 | A | 10/1994 | Cline | |
| 5,425,403 | A * | 6/1995 | Herrmann | 141/314 |
| 5,901,762 | A * | 5/1999 | Rollins | 141/360 |
| 5,988,237 | A | 11/1999 | Bedsole | |
| 6,217,489 | B1 | 4/2001 | Nicholson | |
| 6,863,094 | B2 | 3/2005 | Ensor | |
| 7,303,362 | B2 | 12/2007 | Dunlop et al. | |
| 2005/0076971 | A1 * | 4/2005 | Summerville | 141/231 |
| 2007/0243053 | A1 | 10/2007 | Babiarz | |

FOREIGN PATENT DOCUMENTS

JP 2000-192459 A 7/2000

* cited by examiner

*Primary Examiner* — Darren W Gorman
(74) *Attorney, Agent, or Firm* — Stiennon & Stiennon

(57) ABSTRACT

A sandbag filling apparatus has an auger within a steel pipe mounted to a wheeled frame for easy positioning. The pipe has a sand receiving end positionable beneath a sand pile, and an elevated end with a sand chute for filling sandbags. The auger flights are substantially spaced from the pipe ID and driven by a motor mounted to the pipe. The pipe has an opening which, when positioned beneath a sandpile, allows sand to enter the pipe and to be delivered by the auger to the sand chute. A vibrator is mounted to the pipe between the opening and the elevated end which vibrates a pair of fins arranged on either side of the opening so that sand cannot form a bridge across the opening. Smaller openings may be positioned beneath the fins on either side of the primary sand opening to ease starting the auger with sand present.

21 Claims, 2 Drawing Sheets

SANDBAG FILLING APPARATUS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for filling sandbags in general and to power assisted portable devices for filling sandbags in particular.

Sandbags, which have been used since at least the late 1700s, consist of bags, typically of burlap, cotton and most commonly polypropylene, which are filled with sand or soil and used for flood control, the construction of military fortifications, and even for low-cost housing. A typical sandbag is constructed of circularly woven polypropylene tape and has dimensions of 14"×26" and is designed to hold 50 pounds of sand. Empty sandbags are typically stored locally in anticipation of flooding, or shipped to the site when flooding occurs. The bags are filled and stacked at the site of flooding to direct flood-waters, or create barriers to flood-waters. Sandbags are typically filled by teams of two or three persons, employing shovels and a pile of sand. Sandbags can be filled and placed at a rate of 15-20 bags per hour per person.

Because filling sandbags is typically time critical as a result of rising floodwaters, and the number of laborers available may be limited, many devices for speeding the sandbag filling process have been developed, ranging from a simple scoop which allows a single person to more easily fill a sandbag, to large fully automatic machines. Bag filling devices which are not power assisted may increase bag filling efficiency but they remain limited by the amount of work a person can do over a period of many hours. On the other hand, the larger and more expensive a piece of equipment for filling sandbags is, the fewer devices will generally be available, and if they are available they generally must be moved from greater distances to the site of flooding. Smaller specialized equipment which mounts in the bucket of a front-end loader or BOBCAT® vehicle such as disclosed in U.S. Pat. No. 7,510,365, or freestanding devices such as shown in U.S. Pat. No. 5,988,237 are known, but simpler lower-cost standalone systems are needed if locally available sandbag filling aids are to be more widely available.

SUMMARY OF THE INVENTION

The sandbag filling apparatus of this invention comprises an auger contained within a steel pipe which is mounted to a wheel support frame for easy positioning of the apparatus. The steel pipe has a sand receiving end which is positioned beneath a sand pile, and an elevated end with a sand chute for filling sandbags. The wheel base positions the steel pipe and the auger at an angle with respect to the ground so that the sand is elevated to a suitable height for filling sandbags. A bearing block mounted at each end of the pipe supports the auger shaft within the pipe. The auger is driven by a motor mounted to the elevated end of the pipe through a simple chain drive connected to the shaft of the auger. The upper surface of the pipe near the sand receiving end has a primary opening which allows sand to enter the pipe so it can be transported by the auger to the sand chute to fill sandbags.

To assure continuous flow of sand to the auger a vibrator is mounted to the pipe between the opening and the elevated end. A pair of fins is ranged so that the fins extend upwardly from the sides of the primary sand opening, and parallel to the axis of the pipe at an angle of approximately 45° on either side of the opening. The fins supply sand to the opening and are caused to vibrate by the vibrator so that sand cannot form a bridge across the opening. Secondary smaller openings are positioned beneath the fins on either side of the primary sand opening. Secondary fins positioned on the lower sides of the secondary openings are angled upwardly at 30° and supply sand to the auger through the secondary openings. The secondary openings also assist in starting the auger when the pipe is filled with sand, by providing somewhere for the sand to go during starting and so preventing high starting loads. The sandbag filling device when employing a 4-inch diameter auger in a 6-inch pipe can supply approximately 10 pounds per second of wet or dry sand to the sand chute, using less than 15 amps, on a 120 V line or slightly more than 2 hp for both the drive motor and the vibrator.

It is an feature of the present invention to provide a standalone sandbag filling apparatus.

It is a further feature of the present invention to provide a sandbag filling apparatus which is simple, low cost, and which can be driven with commonly available electrical power.

It is another feature of the present invention to provide a sandbag filling apparatus which can be cost-effectively prepositioned with empty sandbags for rapid response to local emergencies.

It is a yet further feature of the present invention to provide a sandbag filling apparatus which operates by being positioned beneath a sandpile.

Further features and advantages of the invention will be apparent from the following detailed description when taken in conjunction with the accompanying drawings.

DESCRIPTION OF THE PREFERRED EMBODIMENTS

Figure 1:
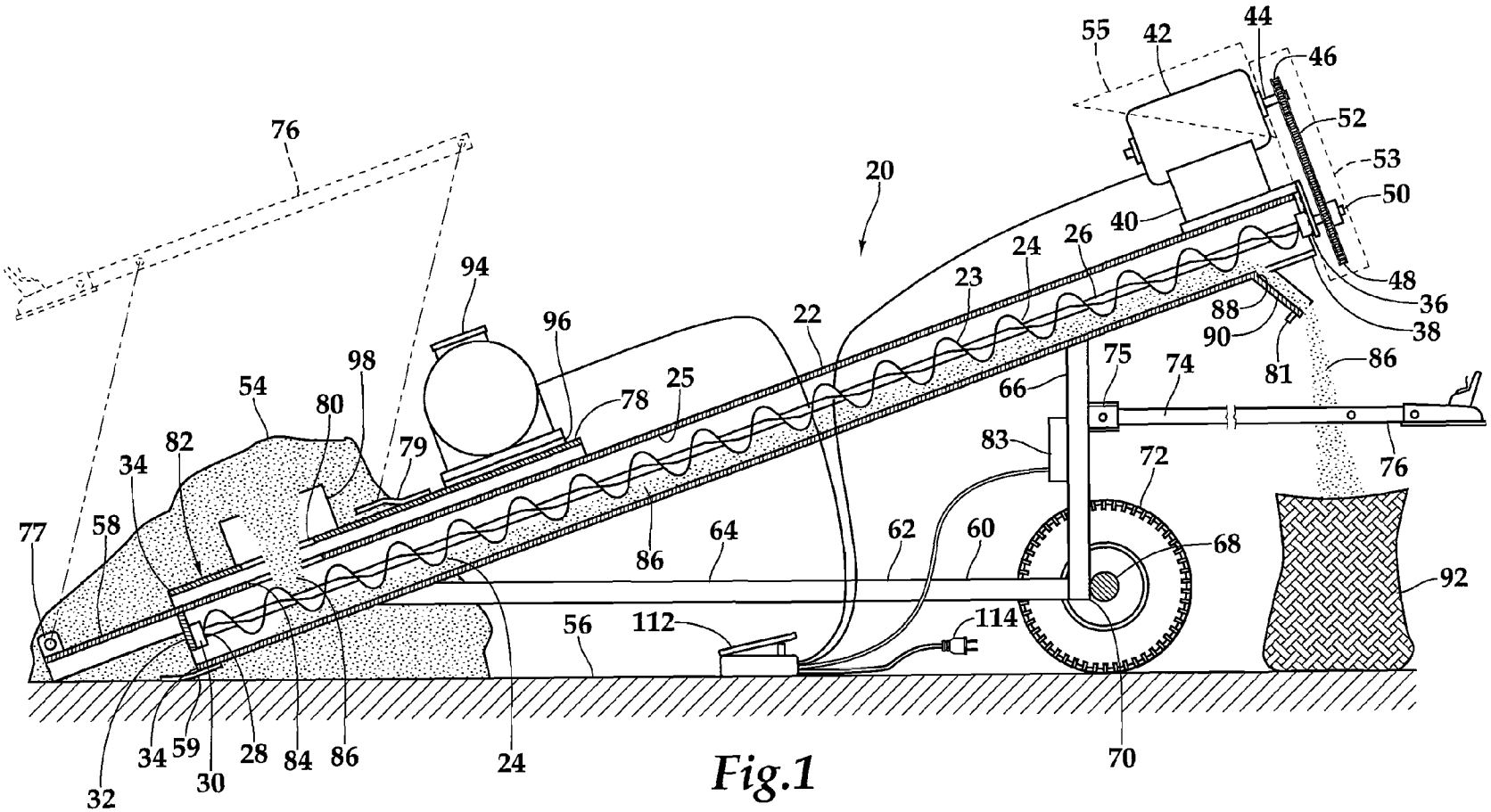
FIG. 1 is a side elevational cross-sectional view of a sandbag filling apparatus of this invention.
Figure 2:
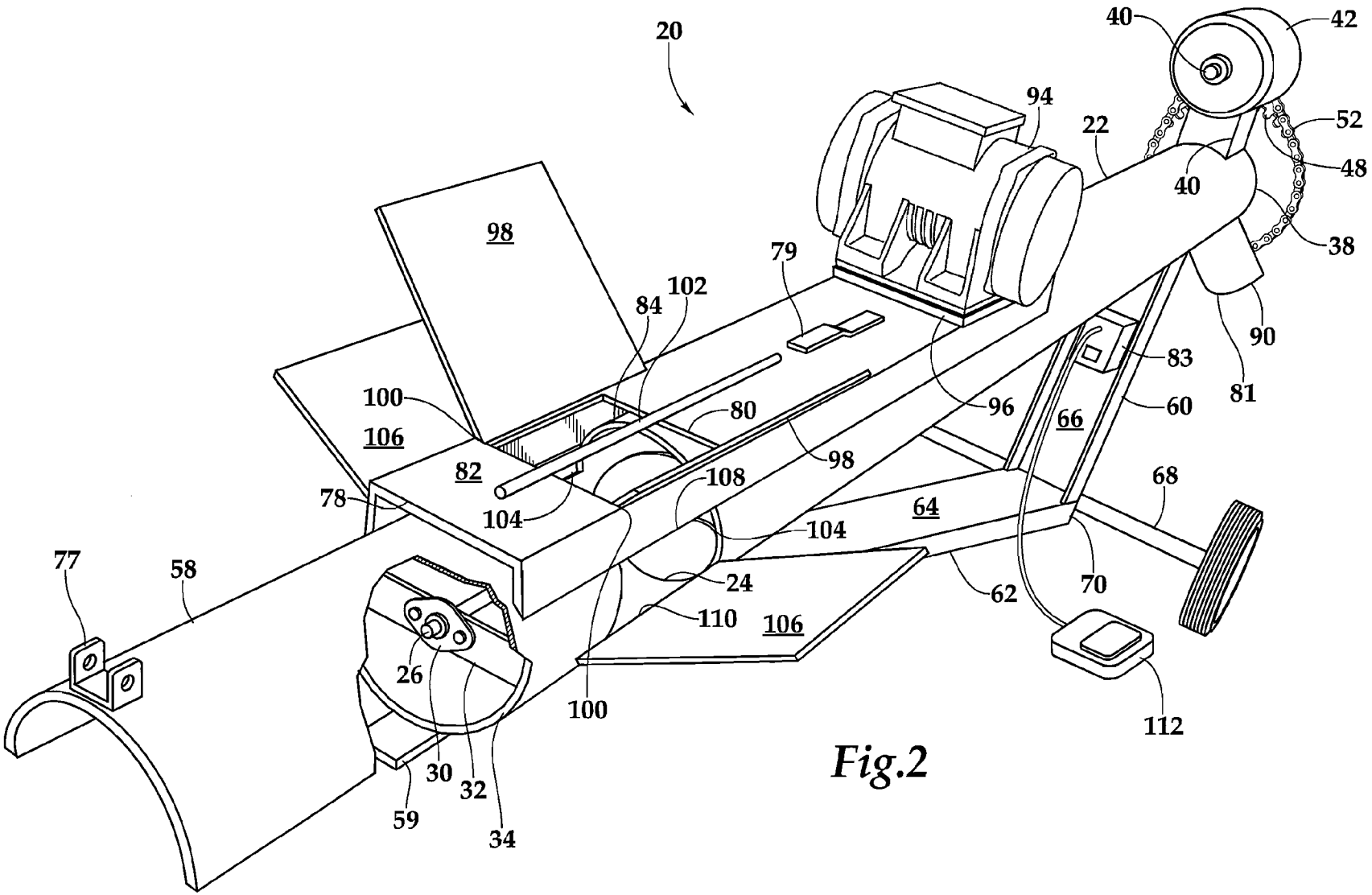
FIG. 2 is a perspective end view of the sandbag filling apparatus of FIG. 1.

Referring more particularly to FIGS. 1-2 wherein like numbers refer to similar parts, a sandbag filling apparatus 20 is shown. The apparatus 20 is comprised of a 6 inch schedule 40 steel sand transport pipe 22 in which is mounted a 4-inch diameter auger 24 such that the auger flights 23 are spaced from the inner wall 25 of the pipe 22. The auger flights 23 may have a 4-inch pitch. The auger 24 has a central shaft 26 which is mounted at its lower end 28 to a bearing block 30 mounted to a crossmember 32 which spans the lower end 34 of the pipe 22. The shaft 26 is also mounted to a bearing block 36 mounted at the upper end 38 of the pipe 22. The upper bearing block 36, as shown in FIG. 1, is mounted to a motor mount 40 to which a drive motor 42 is also mounted. The mount 40 may be bolted to the pipe 22, and the motor 42 in turn bolted to the motor mount. The drive motor 42 has a drive shaft 44 to which is mounted a drive sprocket 46. A speed reduction sprocket 48 is fixedly mounted to an extension 50 of the auger central shaft 26, and is driven by a drive chain 52 which extends between the speed reduction sprocket 48 and the drive sprocket 46. A safety guard 53 is mounted about drive chain as shown in broken lines in FIG. 1, the safety guard includes a shelf 55 which extends over the motor 42 to act as a rain shield.

The sand transport pipe 22 is positioned beneath a sandpile 54 by a lower extension 58 which engages the ground, and a wheeled support frame 60 which positions the pipe 22 at an angle of about 20 degrees with respect to the ground 56. The lower extension 58 is comprised of a hemicylindrical section of pipe about 6-12 inches long which extends beyond the lower end 34 of the pipe 22. The pipe lower end 34 also has a skid plate 59 to protect the pipe 22 from wear and to support the pipe's movement over the ground 56. The wheeled support frame 60 comprises a simple triangular truss 62 comprised of a lower member 64 which is roughly parallel to the ground and a vertical member 66 which extends upwardly. The lower member and the vertical member are welded to the pipe 22 as shown in FIG. 1. A wheel shaft 68 is mounted to the base 70 of the vertical member 66, and supports a pair of wheels 72, one of which is shown in FIG. 1. Mounted to the vertical member 66 is a removable tow bar 74 which terminates at a hitch 76. The wheels 72 and the removable tow bar 74 are not for over-the-road transport of the sandbag filling apparatus 20, but rather for positioning the sandbag apparatus at the work site, and for pushing the sandbag apparatus lower end 34 into the sandpile 54. As shown in FIG. 1, the tow bar 74 may be positioned or pinned into a cylindrical receptacle 75 so that the tow bar can push the sand bag filling apparatus 20 into the sandpile 54. The same tow bar 74, as shown in exploded away, can also be attached to the lower end 34 by a pin to a U-shaped bracket 77 mounted to the lower extension 58 of the pipe 22, with the open end of the hitch 74 engaging a tongue 79 mounted to a C-channel 78.

The six-inch C-channel 78 extends along the pipe 22 from the lower end 34 along about one third of the total pipe, as best shown in FIG. 2. The C-channel 78 is welded to the top of the pipe 22, and has an upwardly opening aperture 80 cut into an upper flange 82. The opening corresponds to an upwardly opening aperture 84 in the pipe 22, as shown in FIG. 1. The openings or apertures 80, 84 allow sand 86 to enter the pipe 22 so that the auger 24 receives the sand and transports it to an outlet 88 near the upper end 38 of the pipe. A chute 90 extends downwardly from the outlet 88 and directs the sand 86 to a sandbag 92 which is held below the chute, with the aid of a protrusion 81 such as a nut welded to the underside of the chute. In order to prevent the sand on either side of the sand inlet opening 80 from forming a bridge which would prevent sand from continuously passing through the openings 80, 84 and filling the pipe 22 it is necessary to vibrate the bridging sand so it cannot form a stable structure. This vibration is accomplished by mounting a electric vibrator 94 to a metal plate 96 which is welded to the C-channel at a location spaced a short distance, about 8 inches, above the sand opening 80. A suitable vibrator 94 can be obtained from Cougar Industries, Inc. of Peru Ill., (model B3X series) an eccentric mass type vibrator driven by 120 voltage. To apply the vibration generated by the vibrator 94 directly to the sand on either side of the sand opening 80, primary metal fins 98, best shown in FIG. 2, are welded to the C-channel on either side of the sand opening. The sand opening 80 extends about 6 inches along the C-channel and is about 5 inches wide. The fins 98 are about 8 inches square by ⅛ inch thick and extend along the lateral sides 100 of the sand opening which extend towards the vibrator 94. The fins are angled outwardly from the C-channel upper flange 82 at an angle of about 45°. To prevent foreign objects from entering the sand inlet opening 80 a rod 102, which is ⅜ inch in diameter, bisects the opening as the rod extends in the axial direction of the pipe 22 as shown in FIG. 2. The rod diameter is a critical dimension—if it is too much larger it can support a bridge of wet sand across the opening 80.

Secondary openings 104 which are also about 6 inches long and about 2.5 inches wide are positioned on either side of the C-channel 78 and immediately below the C-channel and substantially aligned with the sand openings 80, 84 in the C-channel and pipe 22. The secondary openings 104 have upper edges 108 defined by the C-channel 78, and lower parallel edges 110, and our arranged to also feed sand to the auger 24 inside the pipe 22. To facilitate sand entry into the secondary openings 104, secondary fins 106 are welded to the pipe 22 along the lower edges 110 of the secondary openings 104. The secondary fins extend outwardly of the pipe 22 at an angle of 30° from a plane defined by the upper flange 82 of the C-channel, and are similar in size and shape to the primary fins 98, and are also vibrated by the vibrator 94. The secondary openings 104 provide an important function during startup of the sandbag apparatus 20. Startup of the sandbag apparatus may occur frequently as the apparatuses is stopped and started with a foot switch 112 which interrupts electrical power to both the motor 42 and the vibrator 94 from a plug 114 or generator, between the filling of sandbags 92. If the sandbag filling apparatus 20 is filled with sand the starting load on the motor can be excessive without the secondary openings 104 to provide a relief valve for sand during the starting process. An on-off switch 83, as shown in the figures, can be mounted to the frame 60 and arranged to turn off the apparatus 20 while it is still connected to electrical power.

A sandbag apparatus of the type described having a 6-inch schedule 40 pipe 22 and a 82½ inch-long 4-inch auger 24 driven by an approximately one-horsepower motor 42, (8 amps at 120 volts) can supply approximately 10 pounds a second of wet or dry sand 86 to the outlet chute 90. This rate of sand will fill a standard 50 pound sandbag in 5 seconds or at a rate of approximately 720 bags an hour, which is equivalent to the output of about 36 men using shovels and operating from sand piles. The actual number of sandbags which can be filled in an hour with a given number of workers with the sandbag filling apparatus 20 is dependent on whether the sandpile 54 is mechanically supplied from a front-end loader or dump truck, or whether the sandpile is built up by hand with spades.

The clearance of approximately one inch between the four inch auger 24 and the six inch ID pipe 22 substantially eliminates wear between the pipe and the auger flights 23 and prevents or reduces jamming caused by rocks or debris in the sand. Thus the auger diameter may be less than ⅔ (66%) of the diameter of the pipe 22 inside diameter, or less than 75% or 90%. A typical screw conveyor such as used for handling grain acts under the principles of an Archimedes screw pump and is substantially different than the auger arrangement in the present apparatus 20. Such a typical prior art auger arrangement the flights are in relatively close-fitting engagement with the pipe wall would cause rapid wear of the auger and pipe wall when handling the abrasive material represented by the sand and the inevitable rocks contained therein. The ability to handle both dry sand and wet sand is critical as the sand cannot generally be conditioned under the circumstances in which sandbags typically are filled. Although all soils may not be satisfactory, many soils with adequate sand or aggregate content can be used in sandbags if sand is not readily available.

It should be understood that a simple skid could be substituted for the wheels 72, and that the angle with which the two-wheeled support frame 60 supports the pipe 22 may be varied. The diameter of the pipe, and the size of the auger can be scaled to provide greater or lesser material flow, and multiple sand outlets could also be incorporated in the sandbag filling apparatus 20. It should also be understood that the vibrator 94 and motor 42 could be driven pneumatically, hydraulically, or directly by internal combustion engines, mounted to the sandbag apparatus 20 or through power take-off shafts. It should also be understood that the vibrator 94 is operatively connected with the fins 98, which can be of varying size but are arranged so as to prevent bridging of bag filling material which would prevent the flow of the material through the opening 80 into the pipe 22. It should also be understood that the arrangement for driving the auger shaft 26 with a chain drive 52 could be replaced with other cost-effective speed reduction or direct drive mechanism.

It should be understood that fins 98 not only transmit vibration but also act as supplying surfaces and so to a certain extent the larger the fins the larger supply of sand which flows into the auger pipe 22.

It is understood that the invention is not limited to the particular construction and arrangement of parts herein illustrated and described, but embraces all such modified forms thereof as come within the scope of the following claims.

I claim:

1. A sandbag filling apparatus comprising:

an auger pipe defining a pipe axis and having a lower sand receiving end and an upper sand supplying end;

a support structure mounted between the lower sand receiving end and the upper sand supplying end which supports the auger pipe sloping upwardly between the lower sand receiving end and the upper sand supplying end;

an auger having a central shaft, the auger mounted by the central shaft within the auger pipe for rotation within the auger pipe;

a motor mounted to the auger pipe and in driving relation to the central shaft;

wherein portions of the auger pipe define an upwardly opening sand receiving aperture, positioned at the lower sand receiving end of the auger pipe;

wherein portions of the auger pipe define a downwardly opening sand supplying aperture positioned at the upper sand supplying end of the auger pipe;

fins mounted to the auger pipe, one on either side of the sand receiving aperture, each fin extending upwardly and outwardly of the sand receiving aperture; and a vibrator mounted to the auger pipe between the sand receiving aperture and the sand supplying aperture, such that the vibrator causes the fins on either side of the sand receiving aperture to vibrate when the vibrator is activated.

2. The sandbag filling apparatus of claim 1 further comprising a C-channel mounted to and extending along an upper side of the auger pipe, the C-channel extending over the upwardly opening sand receiving aperture, and having a corresponding upwardly opening second aperture positioned above the sand receiving aperture; wherein the fins are mounted to the auger pipe by being welded to the C-channel; and wherein the vibrator is mounted to the C-channel spaced from the second aperture.

3. The sandbag filling apparatus of claim 1 wherein portions of the auger pipe define sidewardly opening apertures on either side of the upwardly opening sand receiving aperture.

4. The sandbag filling apparatus of claim 3 further comprising secondary fins mounted to the pipe and extending upwardly from beneath the sidewardly opening apertures.

5. The sandbag filling apparatus of claim 1 wherein the fins are at least as long along the axis of the pipe as the upwardly opening sand receiving aperture.

6. The sandbag filling apparatus of claim 5 wherein the fins are approximately square in shape.

7. The sandbag filling apparatus of claim 1 further comprising an extension of the pipe, which extends from the lower end of the pipe and supports the pipe together with the support structure.

8. The sandbag filling apparatus of claim 1 wherein the support structure is a wheeled support frame, which holds the auger pipe at an angle of approximately 20° with respect to the ground.

9. A sandbag filling apparatus comprising:

a pipe defining a pipe axis and having a lower sand receiving end and an upper sand supplying end;

a support structure mounted between the lower sand receiving end and the upper sand supplying end which supports the auger pipe sloping upwardly between the lower sand receiving end and the upper sand supplying end;

an auger mounted for rotation within the pipe;

a motor or engine mounted to rotate the auger with respect to the pipe;

wherein portions of the pipe define an upwardly opening sand receiving aperture, positioned at the lower sand receiving end of the pipe;

wherein portions of the pipe define a sand supplying aperture positioned at the upper sand supplying end of the auger pipe;

fins mounted to the auger pipe one on either side of the sand receiving aperture, each fin extending upwardly and outwardly of the sand receiving aperture so as to prevent sand from bridging the aperture when the fins are vibrated; and a vibrator mounted to the auger pipe between the sand receiving aperture and the sand supplying aperture, such that the vibrator causes the fins on either side of the sand receiving aperture to vibrate when the vibrator is activated.

10. The sandbag filling apparatus of claim 9 further comprising a C-channel mounted to and extending along an upper side of the pipe, the C-channel extending over the upwardly opening sand receiving aperture, and having a corresponding upwardly opening second aperture positioned above the sand receiving aperture; wherein the fins are mounted to the pipe by being welded to the C-channel; and wherein the vibrator is mounted to the C-channel spaced from the second aperture.

11. The sandbag filling apparatus of claim 9 wherein portions of the pipe define sidewardly opening apertures on either side of the upwardly opening sand receiving aperture.

12. The sandbag filling apparatus of claim 11 further comprising secondary fins mounted to the pipe and extending upwardly from beneath the sidewardly opening apertures.

13. The sandbag filling apparatus of claim 9 wherein the fins are at least as long along the axis of the pipe as the upwardly opening sand receiving aperture.

14. The sandbag filling apparatus of claim 13 wherein the fins are approximately square in shape.

15. The sandbag filling apparatus of claim 9 wherein the support structure is a wheeled support frame, which holds the pipe at an angle of approximately 20° with respect to the ground.

16. The sandbag filling apparatus of claim 9 wherein the motor is mounted to the pipe, and connected through a chain drive to a central shaft about which the auger is mounted.

17. The sandbag filling apparatus of claim 9 wherein the pipe has an inner wall and the auger is spaced approximately one inch from said inner wall.

18. A sandbag filling apparatus comprising:

an auger pipe defining a pipe axis and having an inside diameter and, the auger pipe having a lower sand receiving end and an upper sand supplying end;

an auger having an outside diameter less than about 90% of the pipe inside diameter and, having a central shaft, the auger mounted by the central shaft within the auger pipe for rotation within the auger pipe;

a motor mounted to the auger pipe and in driving relation to the central shaft;

wherein portions of the auger pipe define an upwardly opening sand receiving aperture positioned at the lower sand receiving end of the auger pipe;

wherein portions of the auger pipe define a sand supplying aperture positioned at the upper sand supplying end of the auger pipe;

fins mounted to the auger pipe, one on either side of the sand receiving aperture; and a vibrator mounted to the sandbag filling apparatus, such that the vibrator causes the fins on either side of the sand receiving aperture to vibrate when the vibrator is activated.

19. The sandbag filling apparatus of claim 18 wherein the auger has an outside diameter less than about 75% of the pipe inside diameter.

20. The sandbag filling apparatus of claim 18 wherein the fins are at least as long along the axis of the pipe as the upwardly opening sand receiving aperture.

21. The sandbag filling apparatus of claim 18 further comprising a wheeled support frame mounted to the pipe, which holds the auger pipe at an angle of approximately 20° with respect to the ground.

* * * * *